US006672475B1

(12) United States Patent
Ho et al.

(10) Patent No.: US 6,672,475 B1
(45) Date of Patent: Jan. 6, 2004

(54) DISPENSING CARTON FOR PAPER SHEET PRODUCTS

(75) Inventors: Monica Ho, Kobe (JP); Diana Jobson Cheshire, Kobe (JP); James Edwin Cartledge, Jr., Kobe (JP); Sumie Goto, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/048,080

(22) PCT Filed: Aug. 5, 1999

(86) PCT No.: PCT/US99/17854

§ 371 (c)(1),
(2), (4) Date: Jan. 24, 2002

(87) PCT Pub. No.: WO01/10740

PCT Pub. Date: Feb. 15, 2001

(51) Int. Cl.[7] ..... B65H 1/00
(52) U.S. Cl. ..... 221/45; 221/47; 221/48; 221/63
(58) Field of Search ..... 221/45, 47, 48, 221/63; 206/233

(56) References Cited

U.S. PATENT DOCUMENTS 3,168,976 A * 2/1965 Metzger
3,239,097 A * 3/1966 Bates et al.
3,257,028 A * 6/1966 Metzger
3,272,385 A * 9/1966 Watkins
3,940,054 A * 2/1976 Goebel et al. ..... 221/63 X
4,073,404 A * 2/1978 Brondyke ..... 221/63
4,413,769 A * 11/1983 Michetti ..... 221/45 X
5,219,421 A * 6/1993 Tipping ..... 221/63
5,316,177 A 5/1994 Boldt
5,415,320 A 5/1995 North et al.
5,501,323 A * 3/1996 Denesha et al. ..... 221/63 X
5,542,598 A * 8/1996 Capo ..... 221/45 X
5,897,023 A * 4/1999 Lee ..... 221/48
6,419,114 B1 * 7/2002 Lenz et al. ..... 221/47

* cited by examiner

*Primary Examiner*—David H. Bollinger
(74) *Attorney, Agent, or Firm*—David K. Mattheis; David M. Weirich; Ken K. Patel

(57) ABSTRACT

Disclosed is a dispensing carton (200) containing a clip of interfolded sheets of a paper product, comprising: (a) a top wall (100) having a dispensing opening (180) through which the sheets (280) are withdrawn from the carton; (b) two pairs of opposing side walls (120, 140); (c) a bottom wall; (d) a dynamic friction reduction material (20) affixed to at least a portion of the inner surfaces of at least one of the pairs of opposing side walls; wherein the dispensing force required to dispense a sheet from the carton is reduced.

10 Claims, 3 Drawing Sheets

DISPENSING CARTON FOR PAPER SHEET PRODUCTS

FIELD

The present invention relates to a dispensing carton for paper sheet products. More specifically, the present invention relates to a carton that provides reduced dynamic friction between the carton and the sheets during dispensing, resulting in easier dispensing and less tearing of the paper sheets during dispensing, particularly for the uppermost sheets that are contained in the carton.

BACKGROUND

It is known to dispense creped paper sheet products such as substantially dry facial tissues or substantially dry paper towels for household use from a carton with a dispensing opening formed in the top of the carton. The use of the word "substantially dry" herein is intended to distinguish such sheets from those sheet products that are impregnated with some type of lotion, which are generally referred to as "wet" or "moist" sheet products. Thus, it should be understood that the dry sheets of the present invention may not actually be 100% dry but may be impregnated with a small amount of lotion or liquid. However, the sheets of the present invention do not typically have a wet or moist feeling in the hand of the user.

Such conventional cartons are available in a variety of designs and shapes; but they can generally be classified as either one of two basic styles. One style is the flat carton and the other is the upright carton. In the flat style cartons, the sheets are laid flat in the bottom of the carton and are withdrawn from the top of the carton or through an opening in the top which partially extends down the front sidewall. The sheets within the carton may interfolded for pop-up dispensing or merely laid on top of each other for reach-in dispensing. In the upright style cartons, the sheets are folded into an inverted unshaped clip and are interfolded for pop-up dispensing. The sheets are withdrawn through a dispensing opening in the top of the carton, which may contain a poly film having a slit to hold the consecutively popped up tissues in place.

In upright type cartons, "fall-back," which occurs as the clip in the carton gets low and the distance from the uppermost sheet to the opening in the top of the carton gets longer, is typically not a problem. In upright cartons, the inverted un-shaped clip maintains all of the sheets within the clip in close proximity to the top opening all times. However, tearing of the sheets upon removal from the carton is a concern because of the frictional forces and pressures associated with the inverted clip being pressed up against the walls of the carton and the intra-sheet contact. These resistive forces can cause the sheets to tear as they are pulled through the dispensing opening. This is particularly true for the first few sheets dispensed after the carton is opened. The problem is lessened as the sheets within the carton are used up and the compression of the clip is reduced.

It has been suggested that one solution to the problem of sheet tears during dispensing is to reduce the number of paper sheets contained in the clip that is packed into the carton. This reduces the pressure associated with the inverted clip being pressed up against the walls of the carton and the intra-sheet contact; the sheets behave as they would after at least some of the sheets have been used up. This, however, is not a cost-effective solution, especially from the viewpoint of the consumers who purchase the cartons.

Another proposed solution is to modify the dispensing opening such that it has a defined "effective open area" or area available for the tissue sheet to pass through the plastic film that covers the opening. See, U.S. Pat. No. 5,415,320, "Upright Facial Tissue Carton," to North et al. on May 16, 1995. However, such a carton may require attention to manufacturing tolerance and requires that a plastic film be used to cover the dispensing opening. In addition, this carton does not appear to have any effect on the frictional forces between the side walls of the carton and the facial tissue sheets, but instead offers a different approach to dispensing.

Thus, there remains a desire to provide cost-effective, easy, and tear-free dispensing of a variety of creped paper sheet products from a pop-up dispensing carton, without the need to reduce the number of sheets per clip that can be packaged in the carton. None of the existing art provides all of the advantages and benefits of the present invention.

SUMMARY

The present invention relates to a dispensing carton containing a clip of interfolded sheets of a paper product, comprising: (a) a top wall having a dispensing opening through which the sheets are withdrawn from the carton; (b) two pairs of opposing side walls; (c) a bottom wall; (d) a dynamic friction reduction material affixed to at least a portion of the inner surfaces of at least one of the pairs of opposing side walls; wherein the dispensing force required to dispense a sheet from the carton is reduced.

These and other features, aspects, and advantages of the invention will become evident to those skilled in the art from a reading of the present disclosure.

BRIEF DESCRIPTION OF THE DRAWINGS

While the specification concludes with claims particularly pointing out and distinctly claiming the invention, it is believed that the present invention will be better understood from the following description of preferred embodiments taken in conjunction with the accompanying drawings in which:

DETAILED DESCRIPTION

Figure 1:
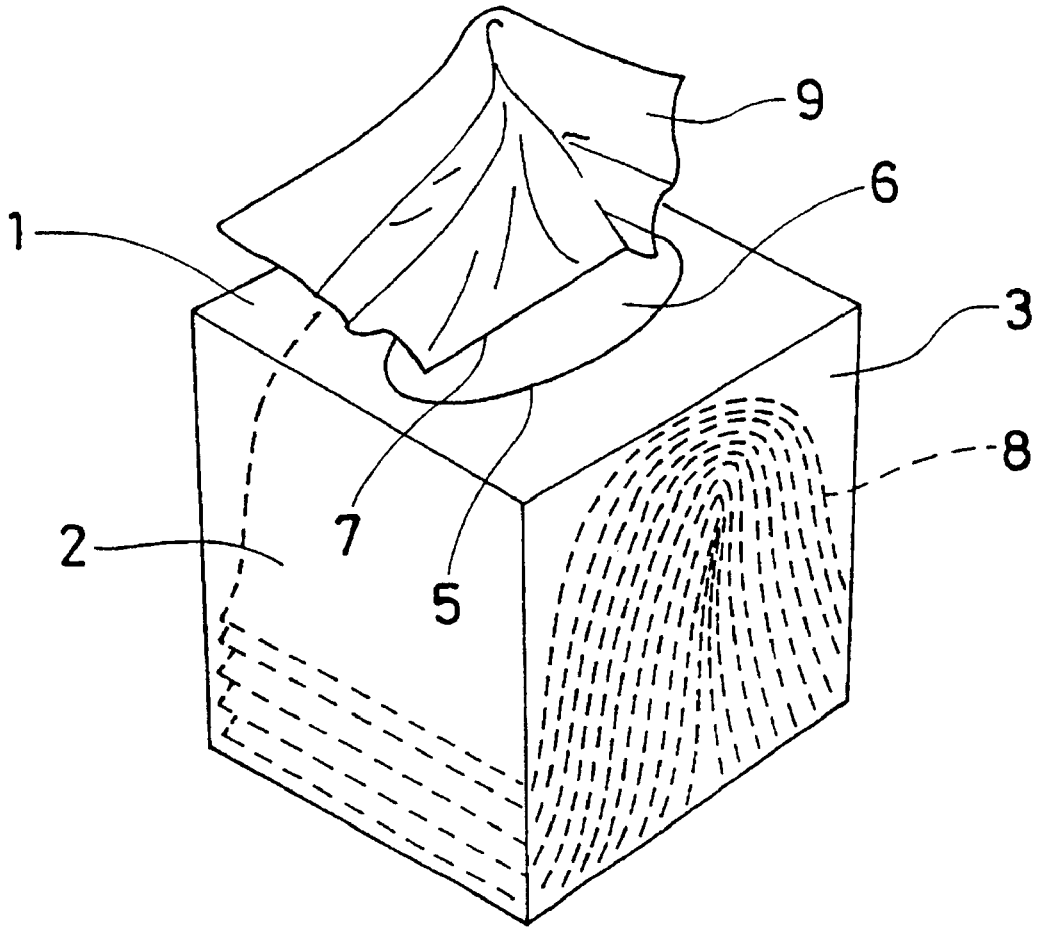
FIG. 1 (PRIOR ART)
FIG. 1 is a perspective view of a prior art dispensing carton having a dispensing opening covered with a plastic film having a slit aligned in the machine direction of the tissues contained within the carton.

A perspective view of a commercially available upright facial tissue carton having a top wall 1, a bottom wall (not shown), and four side walls (two of which are shown, numbered side walls 2 and 3), is shown in FIG. 1. The top wall 1 contains an oval carton opening 5 overlaid with a plastic film 6 have a dispensing opening slit 7. Within the carton is an inverted unshaped clip of interfolded tissues 8 indicated by the phantom lines. The machine direction of the tissues within the clip, as viewed from the top of the carton, is parallel to the direction of the dispensing opening slit 7. During dispensing, the top tissue in the clip is grasped by the user and is withdrawn through the slit. Removal of the top tissue causes the adjacent interfolded tissue, next in line to be dispensed, to be partially pulled through the slit. The partially dispensed tissue 9 is held in a popped-up position by the edges of the slit 7.

Figure 2:
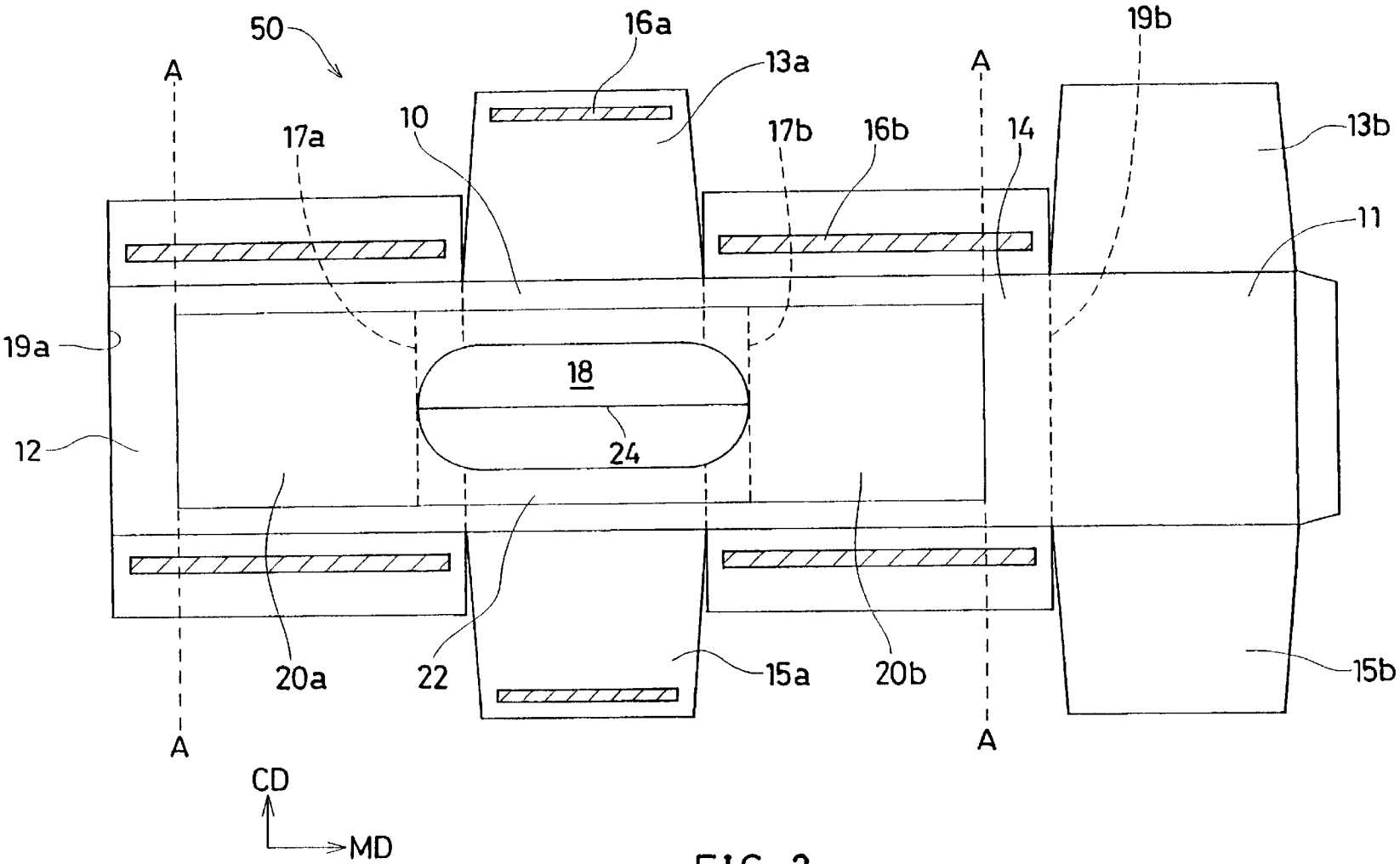
FIG. 2 is a plan view of a preferred embodiment of a carton blank according to the present invention, showing the surface that forms the inner surface of the carton after the blank has been assembled.

FIG. 2 is a plan view of a preferred embodiment of a carton blank 50 according to the present invention. The surface of the blank 50 that will form the inner surfaces of the assembled carton 200 is shown in FIG. 2. The blank 50 is comprised of a top wall panel 10, a bottom wall panel 11, side wall panels 12, 13*a*, 13*b*, 14, 15*a*, and 15*b*.

When the carton is assembled, it will have two pairs of opposing side walls. One opposing pair of side walls is comprised of panels 12 and 14. The other pair of opposing side walls is comprised of panels 13 and 15. Each of these side walls will actually be comprised of two side wall panels—side wall 13 will be comprised of panels 13*a* and 13*b*, and side wall 15 will be comprised of panels 15*a* and 15*b*. When the carton is assembled, panel 13*b* is affixed so that it overlays panel 13*a* such that panel 13*b* is a part of the outer surface of the assembled carton, and panel 13*a* is a part of the inner surface of the assembled carton. The same construction will be used for panels 15*a* (part of the inner surface of the assembled carton) and 15*b* (part of the outer surface of the assembled carton).

The various component panels of the carton blank 50 of the present invention may be assembled in any manner known to those of skill in the art, e.g., by using adhesive or sealant located at areas 16*a* and 16*b* shown on FIG. 2. In addition, it should be noted that the number and configuration of panels that make up the carton blank 50 of the present invention can vary as is known to those of skill in the art, and need not be limited to the configuration illustrated in FIG. 2.

The carton blank is also provided with a dispensing opening 18. The dispensing opening 18 is located in at least the top wall panel 10 of the carton blank 50 and may further extend into one or both of the side wall panels 12 and/or 14, as shown in FIG. 2. The dispensing opening 18 is preferably of an oval shape for ease of dispensing, but the present invention is not limited to dispensing openings having an oval shape, and it should be noted that any shape is within the scope of the present invention.

In addition, the dispensing opening 18 is preferably overlaid with a plastic film 22 having a slit 24. The slitted film 22 can hold a popped-up tissue 90 (see FIG. 3) in place for dispensing and can further provide protection from dust, etc. for the remainder of the contents that would otherwise be exposed to the ambient conditions. The use of such a film 22 has been known in conventional tissue cartons, see, e.g., U.S. Pat. No. 5,414,320. However, such a film 22 does not provide benefits in terms of ease of dispensing or in terms of reducing the number of tears upon dispensing.

According to the present invention, a portion of the inner surface of the blank 50 (and, therefore, of the assembled carton 200) is provided with a dynamic friction reduction material 20*a*, 20*b*. This material 20 is affixed to at least a portion of the inner surfaces of two of the four side walls; i.e., to the inner surfaces of at least one pair of opposing side walls. Preferably, these are the two side walls that have the greatest amount of surface to surface contact with the clip of paper sheets placed in the assembled carton. In FIG. 2, these walls are formed from panels 12 and 14.

Figure 3:
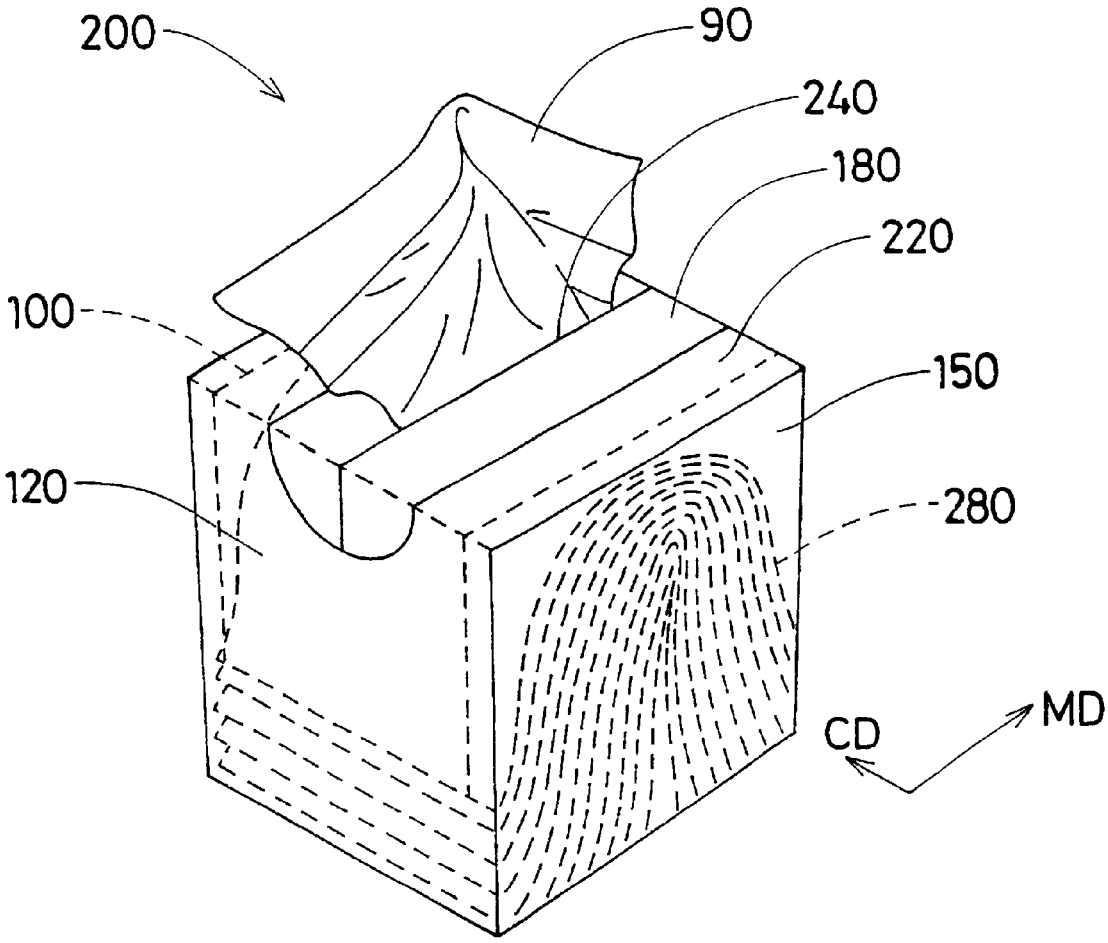
FIG. 3 is a perspective view of the carton blank shown in FIG. 2 in its assembled state.

FIG. 3 shows the blank 50 of FIG. 2 in its assembled state. The carton 200 is comprised of a top wall 100, a bottom wall (not shown), and four side walls (i.e., two pairs of opposing side walls 120 and 140; and 130 and 150), two of the four side walls being shown and numbered as side walls 120 and 150. The top wall 100 contains an oval dispensing opening 180. Within the carton is an inverted unshaped clip of interfolded paper sheets 280 as indicated by phantom lines. The machine direction of the paper sheets within the clip, as viewed from the top of the carton, is preferably parallel to the direction of the dispensing opening slit 240. The exact geometry of the slit 240 is not important herein, and may be provided as known to those of skill in the art.

It can be appreciated from FIG. 3 that the side wall 120 is one of the two side walls that has the greatest amount of surface to surface contact with the paper sheets forming the clip 280; the side wall 140 that is opposed to the side wall 120 also has surface to surface contact with the paper sheets in the clip, but side wall 140 cannot be seen in FIG. 3. The side wall 150 is one of the two side walls 130 and 150 (side wall 130 cannot be seen in FIG. 3) that does not have a large amount of surface to surface contact with the paper sheets in the clip 80. Thus, referring to FIG. 2, the side wall panels that have will have the greatest amount of contact with the paper sheets of clip 280 when the carton is assembled are numbered 12 and 14; these are the side walls that should preferably be provided with the dynamic friction reduction material 20.

Referring again to FIG. 2, the material 20 need not cover the entire inner surfaces of the side wall panels 12 and 14. Preferably the material 20*a*, 20*b* extends at least from imaginary lines 17*a*, 17*b* drawn tangent to the dispensing opening in the cross direction CD, and in the machine direction MD toward the lower edges 19*a* and 19*b* of the side wall panels 12 and 14 (i.e., where the side wall panels adjoin the bottom wall 11; in the case of side wall 12, after assembly). The material 20*a*, b should extend down the side wall to the approximate location of the machine direction edge of the uppermost paper sheet in the clip of sheets that is inserted in the assembled carton. Referring to FIGS. 2 and 3, this location is indicated by the imaginary lines "A—A".

In addition, it is not necessary for the material 20 to extend all the way to the cross direction ("CD") edges of the panels 10, 12, and/or 14.

The friction reduction material 20 may also be affixed to the inner surface of the top wall panel 10 of the carton. Thus, for ease of manufacture and for cost-effectiveness, one continuous piece of material may be used to cover the top wall panel 10, the side wall panel 12 and the side wall panel 13. In effect, such a continuous piece would be comprised of sections 20*a*, 22, and 20*b*, referring to FIG. 2. In addition, it is not necessary that a unitary, continuous piece be used; one or more smaller sections can be used equally advantageously.

Preferably, the friction reduction material 20 is provided as a thin film. The stiffness/softness and/or the thickness of the film affects dispensibility. The film is preferably a teflon, a polypropylene, a polystyrene, or a polyethylene film.

It should be noted that the previously-known plastic films used in connection with a carton opening in the top wall of a pop-up dispensing carton, e.g., as described in U.S. Pat. No. 5,415,320, do not contribute to reduction of dynamic friction during dispensing. These films only serve to protect the popped-up tissue from fallback, and to provide overall protection from contamination or soiling of the contents via the dispensing opening. Therefore, as noted above, it is not necessary to provide the friction reduction material on the inner surface of the top wall herein in order to obtain the dispensing benefit according to the preferred embodiments of the present invention. However, by providing the friction reduction material 20 in combination with a plastic film 22 such as described in U.S. Pat. No. 5,415,320, both benefits can be obtained. As further noted above, it may be advantageous in terms of cost and ease of manufacture to provide one continuous sheet of material 20, 22 that actually serves both purposes.

For example, in one preferred embodiment of the present invention suitable for dispensing v-folded paper towel substrates having per sheet dimensions of approximately 22.5 cm (9 inches)×26.25 cm (10.5 inches), the assembled carton dimensions are approximately 12 cm in width, 16 cm in height, and 11.2 cm in length. The dimensions of the friction reduction material that are used on the side wall panels, and also on the top wall panel, are approximately 11 cm by 37.2 cm (one continuous section of the friction reduction material). The carton material is a 50 $\mu$m recycled paperboard, and the friction reduction material is a 50 $\mu$m low density polyethylene film. In this embodiment, the friction reduction material also serves to cover the dispensing opening of the carton for preventing contamination and fallback.

In another preferred embodiment of the present invention, the walls themselves may be made from a material that provides reduced dynamic friction as the sheets are removed. In this embodiment, there is no need to affix an additional friction reduction material 20*a* or 20*b* to the side walls.

EXAMPLES

In order to illustrate the dispensing benefits of the preferred embodiments of the present invention, a number of different paper substrates were measured for dynamic coefficient of friction and dispensing force, comparing cartons constructed according to the present invention, i.e., those provided with the dynamic friction reduction material, to conventional cartons, i.e., those without the dynamic friction reduction material.

A. Dynamic Coefficient of Friction

Dynamic coefficient of fiction was measured according to the JIS standard test method VCM with a 40 gram load. According to this method, a probe is dragged across a test sample at a certain speed, and dynamic coefficient of friction is measured. The following results are an average for five samples.

| Material of Carton Inner Wall | Average Dynamic Coefficient of Friction (n = 5) |
|---|---|
| Cardboard | 0.43 |
| Cardboard with Friction Reduction Material *1 Affixed | 0.22 |

*1:50 $\mu$m low density polyethylene film

| Paper Substrate | Average Dynamic Coefficient of Friction Using a Cardboard Probe (n = 5) | Average Dynamic Coefficient of Friction Using a Friction Reduction Material Probe (n = 5) |
|---|---|---|
| BOUNTY Through Air-dried Paper Towel Substrate *1 | 0.59 | 0.44 |
| BOUNTY Conventional Paper Towel Substrate *2 | 0.52 | 0.37 |
| PUFFS PLUS Facial Tissue | 0.41 | 0.31 |

-continued

| Paper Substrate | Average Dynamic Coefficient of Friction Using a Cardboard Probe (n = 5) | Average Dynamic Coefficient of Friction Using a Friction Reduction Material Probe (n = 5) |
|---|---|---|
| Substrate *3 | | |
| PUFFS Regular Facial Tissue Substrate *3 | 0.44 | 0.33 |

*1, *2: The BOUNTY paper towel substrates are creped, dry paper towel substrates available from the Procter & Gamble Co. of Cincinnati, Ohio, USA.
*3: The PUFFS substrate is a creped, dry or lotioned facial tissue, available from the Procter & Gamble Co. of Cincinnati, Ohio, USA.

B. Dispensing Force

The force required to remove a paper sheet from a dispensing carton provided with a friction reduction material according to the present invention, and from a conventional carton, is measured as follows. Herein this force is referred to as the "dispensing force."

Dispensing force is measured according to the (modified) JIS standard test method JIS B7721, General Pulling Test. The Conditioning Room is temperature and humidity controlled within the following limits: (1) relative humidity ±2%; and (2) temperature 22.78° C.±1.1° C. (73° F.±2° F.). The force tester is a Sintech Frame Instron #5564 with 100 Newton load cell, plexiglass sample holder, and jaw with two flat faces.

The plexiglass sample holder is installed in the lower position of the Instron. The jaw is installed with the two flat faces in the upper position, and the air supply is connected. The upper jaw orientation should allow the jaw to close from side to side. This allows increased visual alignment when positioning the paper sheets.

Following the installation of the necessary test equipment, the instrument should be calibrated. The "Simple Tensile Test" is an appropriate method with variations based on the data that is needed. For example, a setting for the in/min crosshead speed that is appropriate herein is 98. This more closely represents consumer removal patterns than the slower settings. In addition the gauge length should be determined by the height of the carton being tested.

Samples should be conditioned about 2 hours prior to testing. Cartons should be opened either by removing any poly overwrap or by removing the tear panel.

The placement orientation in the plexiglass holder should be consistent, for example, by placing the carton in the holder with the opening centered under the jaw. (It may also be helpful if the code date on the carton is always oriented to the same side.)

Prior to carton placement in the holder, the tissue fold should be loosened or pulled up just enough so that the jaw can grasp it. Care should be used not to bias the test by loosening the tissue too much. The jaw should be lowered and the tissue positioned in the jaw. The first pull may be somewhat difficult due to the jaw placement and the tightness of the tissue in the carton. Once the tissue has been secured in the jaw and the carton placement is centered, the test is started. After the initial pull, positioning the tissue in the jaw will become easier.

All substrates are v-folded and interleaved. The clip is folded in half to form a U before inserted into the carton. Paper towel substrates are approximately 22.5 cm (9 inches)×26.25 cm (10.5 inches); PUFFS substrates are approximately 22 cm (8.8 inches)×20.5 cm (8.2 inches).

The cartons are sized to fit the substrate size appropriately.

TABLE 1

BOUNTY Through Air-Dried Paper Towel Substrate (packed 42 sheets to a carton)

| Sheet Being Dispensed | 1st of 42 | 2nd of 42 | 3rd of 42 | 4th of 42 | 5th of 42 |
|---|---|---|---|---|---|
| Dispensing Force (g) | | | | | |
| With Friction Reduction Material | 865 | 786 | 822 | 687 | 591 |
| Without Friction Reduction Material | 1598 | 1410 | 1367 | 1273 | 1104 |
| Percent Reduction in Dispensing Force | 45.9% | 44.3% | 39.9% | 46% | 46.5% |

TABLE 2

BOUNTY Conventional Paper Towel Substrate (packed 40 sheets to a carton)

| Sheet Being Dispensed | 1st of 40 | 2nd of 40 | 3rd of 40 | 4th of 40 | 5th of 40 |
|---|---|---|---|---|---|
| Dispensing Force (g) | | | | | |
| With Friction Reduction Material | 621 | 547 | 587 | 501 | 569 |
| Without Friction Reduction Material | 1357 | 989 | 1027 | 732 | 798 |
| Percent Reduction in Dispensing Force | 54.2% | 44.7% | 42.8% | 31.6% | 28.7% |

TABLE 3

PUFFS PLUS Facial Tissue Substrate (packed 74 sheets to a carton)

| Sheet Being Dispensed | 1st of 74 | 2nd of 74 | 3rd of 74 | 4th of 74 | 5th of 74 |
|---|---|---|---|---|---|
| Dispensing Force (g) | | | | | |
| With Friction Reduction Material | 288 | 275 | 245 | 187 | 157 |
| Without Friction Reduction Material | 312 | 297 | 288 | 267 | 223 |
| Percent Reduction in Dispensing Force | 7.7% | 7.4% | 14.9% | 30% | 29.6% |

TABLE 4

PUFFS Regular Facial Tissue Substrate (packed 105 sheets to a carton)

| Sheet Being Dispensed | 1st of 105 | 2nd of 105 | 3rd of 105 | 4th of 105 | 5th of 105 |
|---|---|---|---|---|---|
| Dispensing Force (g) | | | | | |
| With Friction Reduction Material | 156 | 142 | 123 | 112 | 102 |
| Without Friction Reduction Material | 256 | 257 | 251 | 223 | 232 |
| Percent Reduction in Dispensing Force | 39.1% | 44.7% | 51% | 49.8% | 54.7% |

No tears are seen during dispensing. It can be therefore be seen that the average coefficient of dynamic friction for the carton inner wall is reduced by the addition of the dynamic friction reduction material, e.g. from 0.43 to 0.22 (by about 50%), and the dispensing force is at least reduced to less than the tear strength of a sheet contained in the carton, e.g., dispensing force is decreased up to over 50%.

Thus, the embodiments disclosed herein provide the advantages of ease of dispensing and less sheet tearing during dispensing without having to reduce the number of sheets that are packed into a carton. The preferred embodiments herein are also cost effective and easy to manufacture.

All cited references are incorporated herein by reference in their entireties. Citation of any reference is not an admission regarding any determination as to its availability as prior art to the claimed invention.

Herein, "comprising" means that other steps and other components which do not affect the end result can be added. This term encompasses the terms "consisting of" and "consisting essentially of."

It is understood that the examples and embodiments described herein are for illustrative purposes only and that various modifications or changes in light thereof will be suggested to one of skill in the art without departing from the scope of the present invention.

What is claimed is:

1. A dispensing carton containing a clip of interfolded sheets of a paper product, comprising:

(a) a top wall having a dispensing opening through which the sheets are withdrawn from the carton;

(b) two pairs of opposing side walls;

(c) a bottom wall;

(d) a dynamic friction reduction material affixed to at least a portion of the inner surfaces of at least one of the pairs of opposing side walls;

wherein the dispensing force required to dispense a sheet from the carton is reduced.

2. The carton of claim 1 wherein the dispensing opening is covered with a plastic film having a slit through which the sheets are dispensed.

3. The carton of claim 2 wherein the dispensing opening further extends into the side walls that are provided with the friction reduction material.

4. The carton of claim 1 wherein the friction reduction material is selected from the group consisting of teflons, polystyrenes, polypropylenes, and polyethylenes.

5. The carton of claim 1 wherein the friction reduction material extends down the side walls in the direction of the bottom wall to the approximate location of the machine direction edge of the uppermost paper sheet in the clip of sheets that is inserted in the carton.

6. The carton of claim 1 wherein the clip is comprised of interleaved sheets of paper towels.

7. The carton of claim 1 wherein the clip is comprised of interleaved sheets of facial tissues.

8. The carton of claim 1 wherein the dispensing force is at least reduced to less than the tear strength of a sheet contained in the carton.

9. The carton of claim 8 wherein the dispensing force is decreased up to over 50%.

10. The carton of claim 1 where the average coefficient of dynamic friction for the carton inner wall is reduced by about 50%.

* * * * *

UNITED STATES PATENT AND TRADEMARK OFFICE

CERTIFICATE OF CORRECTION

PATENT NO. : 6,672,475 B1
DATED : January 6, 2004
INVENTOR(S) : Monica Ho et al.

It is certified that error appears in the above-identified patent and that said Letters Patent is hereby corrected as shown below:

Column 1,
Line 39, delete “unshaped” and insert -- u-shaped --.
Line 48, delete “un-shaped” and insert -- u-shaped --.

Column 2,
Line 60, delete “unshaped” and insert -- u-shaped --.

Column 3,
Line 67, delete “unshaped” and insert -- u-shaped --.

Signed and Sealed this

Sixth Day of July, 2004

JON W. DUDAS
*Acting Director of the United States Patent and Trademark Office*